US006537643B1

(12) United States Patent
Poulakis

(10) Patent No.: US 6,537,643 B1
(45) Date of Patent: Mar. 25, 2003

(54) ADHERING CLOSURE ELEMENT

(75) Inventor: Konstantinos Poulakis, Hildrizhausen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/689,766

(22) Filed: Oct. 13, 2000

(30) Foreign Application Priority Data

Aug. 16, 2000 (DE) ..... 100 39 940

(51) Int. Cl.[7] ..... A44B 21/00

(52) U.S. Cl. ..... 428/100; 428/99; 428/120; 428/126; 428/900; 24/442

(58) Field of Search ..... 428/99, 100, 126, 428/120, 900; 24/442

(56) References Cited

U.S. PATENT DOCUMENTS 4,709,523 A * 12/1987 Broderick et al. ..... 428/126
4,784,890 A * 11/1988 Black ..... 428/100
5,945,193 A * 8/1999 Pollard ..... 428/100

FOREIGN PATENT DOCUMENTS

DE 198 28 856 C1 10/1999

* cited by examiner

*Primary Examiner*—Alexander S. Thomas
(74) *Attorney, Agent, or Firm*—Smith, Gambrell & Russell, LLP

(57) ABSTRACT

In an adhering closure element with a carrier strip (10) with meshing parts (12) arranged on it, and with a cover strip (20) covering the carrier strip (10) on the side turned away from the meshing parts (12), which is wider than the carrier strip (10), the two free side edge areas (21) of the cover strip (20) are folded over themselves, in the direction of the carrier strip (10) along a fold line (29), which runs in the longitudinal direction, so that the end edges (31) of the free side edge areas (21) of the cover strip (20) face the longitudinal edges (33) of the carrier strip (10).

17 Claims, 1 Drawing Sheet

ADHERING CLOSURE ELEMENT

INTRODUCTION AND BACKGROUND

The present invention concerns an adhering closure element with a carrier strip with meshing parts arranged on it and with a cover strip, which covers the carrier strip on the side turned away from the meshing parts, which is wider than the carrier strip, so that free side edge areas of the cover strip extend beyond the correlating longitudinal edges of the carrier strip, on both sides.

Adhering closure elements of this type, in which a large number of one-piece meshing parts in the form of stems with thickened sections are located at the meshing or front side of the carrier strip, are common on the market. DE 198 28 856 C1 describes a process for producing the carrier strip of such adhering closure elements. In this process, a thermoplastic, in particular, polyolefin or polyamide, is conducted to a slot, in a plastic or liquid state, between a pneumatic tool and a molding tool, wherein a screen with continuous cavities is used as the shaping element on the shaping tool and the meshing parts are formed by solidifying the thermoplastic, at least partially, in the cavities of the screen. In this way, a so-called microadhering closure with 200–400 meshing parts per $cm^2$ is formed. Instead of the mushroom-type meshing parts hereby formed, a carrier strip in the form of a textile material can also be provided, in which the meshing parts are formed by a tubular material, which forms one piece with the textile carrier strip, for example. Instead of the tubular material, a tuft or a felt structure can also be used.

Adhering closures formed in this manner are used in many different ways, for example, in the motor vehicle industry, floor covering technology, for clothing of every type and for special applications in machine construction. The adhering closures have proved to be a good technique for detachable and functionally reliable connections and closures in these fields.

If such adhering closure elements are used for airplane and motor vehicle passenger seats, they are used to affix seat covers to foam body parts, wherein one of the adhering closure elements is also foamed into the upholstery foam material during production of the individual seat, and the adhering closure element with the corresponding meshing parts is affixed, especially, sewed, on the upholstery cover material. For the production of the foam body parts, the adhering closure parts are introduced into so-called receiving pipes in a foam mold, and by the introduction of foam material into the free cross sections of the foam mold, preferably, polyurethane foam, the adhering closure elements are affixed to the foam body parts during the foam process. As a rule, the used pipes extend beyond the other walls of the foam mold and thus later form groove-like recesses in the foam body part, into which the upholstery cover material with the other corresponding adhering closure element then meshes. In this way, it is possible to reconstruct the sewing and shaping configurations on the individual seat.

So as to prevent foam material from penetrating the area of the meshing parts during the foaming of the foam mold, wherein their meshing effect would be nullified, the adhering closure elements, which are commercially common for such applications, are provided with a cover strip on the back side of the carrier strip, which is turned away from the meshing parts, which is wider than the carrier strip, so that free side edge areas of the cover strip protrude laterally beyond the carrier strip on both sides (for example, corresponding to the subsequently published German Patent Application No. 199 56 011.0). The protruding side edge areas serve to form a foam barrier in that these side edge areas are adjacent to the mold walls of the foam mold, which surround a mold trough, in which the carrier strip with the meshing parts is taken up. By securing the adhering closure element to the wall of the foam mold, which can be done, for example, by means of magnetic fixing agents, the adjacent location of the side edge areas of the protruding cover strip blocks the access of foam to the mold trough which takes up the meshing parts.

On the basis of this state of the art, an object of the present invention is to improve the known adhering closure elements of the aforementioned type to the effect that the foam barrier formed by the side edge areas of the cover strip attain a particularly reliable sealing effect.

SUMMARY OF THE INVENTION

The above and other objects of the invention can be achieved by an adhering closure element having a carrier strip with meshing parts arrayed on a surface thereof and with a cover strip covering the carrier strip on a side of the carrier strip that is turned away from the meshing parts. The cover strip is wider than the carrier strip so that free side edge areas of the cover strip extend, on both side edges, beyond the correlated longitudinal edges of the carrier strip.

A feature of the invention is that both free side edge areas of the cover strip are folded over themselves, in the direction of the carrier strip along a fold line which runs in the longitudinal direction, so that the end edges of the free side edge areas of the cover strip face the longitudinal edges of the carrier strip.

Since, in accordance with the invention, the two free side edge areas of the cover strip are folded around itself in such a way that the end edges of the free side edge areas are turned toward the longitudinal edges of the carrier strip, the cover strip on both sides forms a kind of sealing-lip, which extends along the area with the meshing parts and is adjacent to the wall parts of the foam mold which surround the mold trough, in which the meshing parts are taken up during the foam process. This sealing lip is pressed against facing wall parts of the mold by the foam material introduced into the foam mold, wherein the sealing lip presses close to the wall areas forming the sealing surface because of a certain pliability in the area of the fold line, so that the desired improvement of the sealing effect of the foam barrier is attained.

Preferably the fold lines are placed into the side edge areas of the cover strip in such a way that the side edge areas are subdivided into equal halves, and the end edges of the cover strip are therefore essentially flush with the longitudinal edges of the carrier strip.

In a preferred embodiment, the cover strip has ferromagnetic properties, at least in its free side edge areas, so that the adhering closure element can be held in position with the aid of a magnetic holding device on the foam mold, for example, by permanent magnetic strips, which are embedded in the foam mold or the receiving pipes of the foam mold in line with the side edge areas of the cover strip.

Preferably the cover strip has a fleece with embedded ferromagnetic particles, which is connected with the side of the carrier strip via a connecting device, which is turned away from the side with the meshing parts.

The connecting device can be formed from an adhesive layer. In order to impart a certain flexural strength to the adhering closure element, which facilitates the handling of the adhering closure element when it is placed in the foam mold, and in particular, when prespecified lengths of the adhering closure element, in complicated three-dimensional structures, must be placed into the pertinent foam mold, a stiffening profile can be embedded into the adhesive layer which is located between the cover strip and carrier strip. This may be an iron wire, which is provided with a coating, in particular, is zinc-coated, against corrosion. When using a ferromagnetic stiffening wire, this can also contribute to the magnetic securing of the position of the adhering closure element to the foam mold.

The meshing parts of the adhering closure element, in accordance with the invention, can be formed from hook-, tube-, tuft-, or mushroom-like closure heads.

BRIEF DESCRIPTION OF DRAWINGS

An embodiment of the adhering closure part is explained in more detail below with the aid of the drawings. In a diagrammatic representation, which is not according to scale, the figures show the following.

DETAILED DESCRIPTION OF INVENTION

Figure 1:
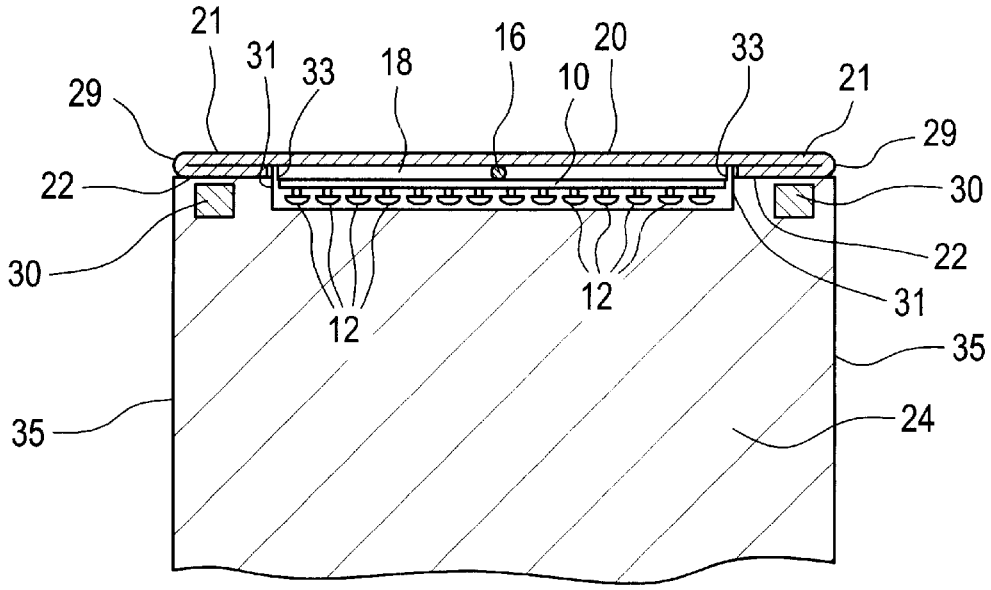
FIG. 1, a section of a receiving pipe of a foam mold, wherein an adhering closure element is placed (partially, in section; partially in view) into the mold trough of the receiving pipe.
Figure 2:
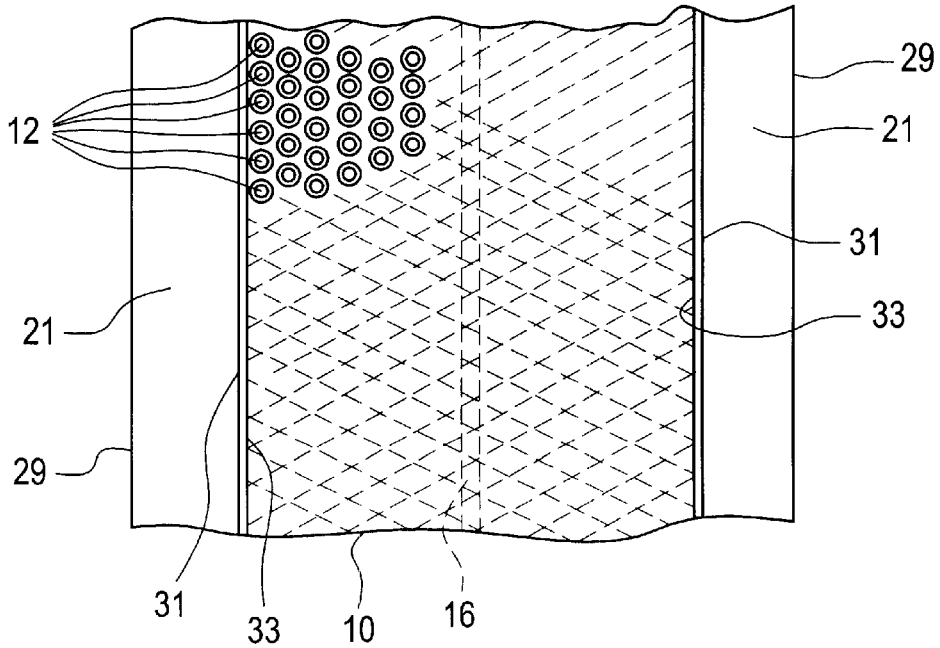
FIG. 2, a top view of the adhering closure element, seen in the direction of its front side, with meshing parts.

The adhering closure element, in accordance with the invention, has a carrier strip 10. Meshing elements 12, arranged, in rows, next to one another and behind one another, are present on one side of the carrier strip 10. For example, the adhering closure element is a so-called microadhering closure element, in which 200–400 meshing elements per $cm^2$ are provided on a carrier strip 10 with a thickness of 0.1–0.3 mm. A process for producing the carrier strip of such a microadhering closure is disclosed in DE 198 28 856 C1, which is incorporated herein by reference. In this known process, a thermoplastic polymer or resin is conducted to a slot between a pneumatic tool and a molding tool, in which a screen with continuous cavities is used as the shaping element and in which the meshing parts are formed by the plastic, which solidifies, at least in part, in the cavities of the screen.

The carrier strip 10 has a bending-resistant stiffening profile, which extends along the entire length of the carrier strip 10. In the embodiment shown, this stiffening profile consists of a wire 16, in particular, in the form of a metal wire. This wire 16 is connected with the carrier strip 10 on its back side, turned away from the meshing parts 12, via a connecting device designated, as a whole, by 18.

In particular, an adhesive layer, into which the wire 16 is embedded, is used as the connecting device 18. This adhesive layer can consist, for example, of a moisture-crosslinking polyurethane. The connecting device 18 completely covers one side of the carrier strip 10 and is firmly connected with it. The diameter ratios are selected in such a way that the connecting device 18, in the form of the adhesive layer, corresponds to the thickness of the wire 16. It would be conceivable, however, that with respect to its thickness, the connecting device 18 accepts the wire 16 with its prespecified diameter only partially.

The connecting device 18 has a cover strip 20, in the form of a textile or plastic fleece, on its side turned or facing away from the carrier strip 10. The cover strip 20 projects, by a specified distance, laterally, along the longitudinal edges 33 of the carrier strip 10; that is, a free side edge area 21 of the cover strip 20 is formed on both sides of the carrier strip 10, wherein this free side edge area 21 is provided so as to be adjacent to the wall parts 22 on the upper side of a receiving pipe 24, which is the component of a foam mold, which is not depicted in FIG. 1. The receiving pipe 24 has a mold trough in the form of a recess 28, wherein its free cross section is adapted to the carrier strip 10 of the adhering closure element with its meshing parts 12, which is to be accepted in this mold trough. As a rule, the meshing parts 12 abut, on the front side, with the base of the recess 28.

As can be seen from FIG. 1, the free side edge areas 21 of the cover strip 20 are folded over themselves, in the direction of the front side which has the meshing parts 12; that is, toward the side facing the receiving pipe 24, wherein the fold lines 29 extend in the longitudinal direction of the cover strip 10 and in the embodiment shown, are aligned with the side walls 35 of the receiving pipe 24. In the adhering closure element, which is placed at the receiving pipe 24, as is shown in FIG. 1, therefore, the cover strip 20 lies on the wall parts 22, which laterally limit the mold trough or recess 28, with a double material layer. This double layer of the folded cover strip 20 acts as a lip sealing during the foam process; that is, when the foam material is poured into the foam mold; the lip sealing prevents the penetration of foam material into the recess 28, so that the meshing parts 12 of the carrier strip 10, which are taken up in the recess 28, are protected against the danger of being cemented by the penetrating foam material.

Along the wall parts 22 of the receiving pipe 24, permanent magnetic strips 30 or a number of individual permanent magnets are arranged, which, together with the ferromagnetic property of the cover strip 20, form a magnetic holding device, by means of which the folded side edge areas 21 of the cover strip 20, and thus the adhering closure element, are secured to the receiving pipe 24. The cover strip 20, which is preferably formed from a fleece, in particular, made of plastic material, preferably made of polyester, receives its ferromagnetic property by the embedding of ferromagnetic particles into the material of the cover strip. The use of a fleece as the cover strip makes possible a good crosslinking with the polyurethane mold foam, which is introduced into the foam mold for the production of upholstery parts for airplane seats, so that it is ensured that the adhering closure elements are anchored securely on the upholstery part by the foaming.

Further variations and modifications of the foregoing will be apparent to those skilled in the art and are intended to be encompassed by the claims appended hereto.

German priority application 100 39 940.1 is relied on and incorporated herein by reference.

What is claimed is:

1. Adhering closure element comprising a carrier strip with a plurality of meshing parts arranged on it and with a cover strip, covering the carrier strip on a side turned away from the meshing parts, which is wider than the carrier strip, so that free side edge areas of the cover strip extend, on both sides, beyond correlated longitudinal edges of the carrier strip, wherein both free side edge areas of the cover strip are folded over themselves, in the direction of the carrier strip along a fold line, which runs in the longitudinal direction, so that end edges of the free side edge areas of the cover strip face longitudinal edges of the carrier strip;

wherein the cover strip has ferromagnetic properties, at least in its free side edge areas;

wherein the cover strip has a fleece with embedded ferromagnetic particles.

2. Adhering closure element according to claim 1, wherein the fleece is connected, via a connecting device, with the carrier strip on one of its sides, which is turned away from another of its sides, which has the meshing parts.

3. Adhering closure element according to claim 2, wherein the connecting device is formed from an adhesive layer.

4. Adhering closure element according to claim 3, wherein a stiffening profile is embedded in the adhesive layer.

5. Adhering closure element according to claim 3, wherein an iron wire is embedded in the adhesive layer.

6. Adhering closure element according to claim 3, wherein the fleece of the cover strip is formed from plastic material.

7. Adhering closure element according to claim 2, wherein the fleece of the cover strip is formed from plastic material.

8. Adhering closure element according to claim 1, wherein the fleece of the cover strip is formed from plastic material.

9. Adhering closure element according to one of claims 6–8, wherein said plastic material is polyester.

10. Adhering closure element according to claim 1, wherein the meshing parts are formed from hook-, tube-, tuft- or mushroom-like closure heads.

11. Adhering closure element comprising a carrier strip with a plurality of meshing parts arranged on it and with a cover strip, covering the carrier strip on a side turned away from the meshing parts, which is wider than the carrier strip, so that free side edge areas of the cover strip extend, on both sides, beyond correlated longitudinal edges of the carrier strip, wherein both free side edge areas of the cover strip are folded over themselves, in the direction of the carrier strip along a fold line, which runs in the longitudinal direction, so that end edges of the free side edge areas of the cover strip face longitudinal edges of the carrier strip;

wherein the fold lines subdivide the free side edge areas of the cover strip in equal halves so that the end edges of the same are essentially flush with the longitudinal edges of the carrier strip;

wherein the cover strip has ferromagnetic properties, at least in its free side edge areas;

wherein the cover strip has a fleece with embedded ferromagnetic particles.

12. Adhering closure element according to claim 11, wherein the fleece is connected, via a connecting device, with the carrier strip on one of its sides, which is turned away from another of its sides, which has the meshing parts.

13. Adhering closure element according to claim 12, wherein the connecting device is formed from an adhesive layer.

14. Adhering closure element according to claim 13, wherein a stiffening profile is embedded in the adhesive layer.

15. Adhering closure element according to claim 13, wherein an iron wire is embedded in the adhesive layer.

16. Adhering closure element according to claim 11, wherein the fleece of the cover strip is formed from plastic material.

17. Adhering closure element according to claim 11, wherein the meshing parts are formed from hook-, tube-, tuft- or mushroom-like closure heads.

* * * * *